US011220798B2

(12) United States Patent
Moore

(10) Patent No.: US 11,220,798 B2
(45) Date of Patent: Jan. 11, 2022

(54) STANCHION

(71) Applicant: Moore Innovative Solutions LLC, Fort Collins, CO (US)

(72) Inventor: Mark J. Moore, Fort Collins, CO (US)

(73) Assignee: Moore Innovative Solutions LLC, Fort Collins, CO (US)

( * ) Notice: Subject to any disclaimer, the term of this patent is extended or adjusted under 35 U.S.C. 154(b) by 197 days.

(21) Appl. No.: 16/549,913

(22) Filed: Aug. 23, 2019

(65) Prior Publication Data

US 2021/0054585 A1 Feb. 25, 2021

(51) Int. Cl.
*E01F 13/02* (2006.01)

(52) U.S. Cl.
CPC ..... *E01F 13/022* (2013.01)

(58) Field of Classification Search
CPC ..... E01F 13/022; E04G 21/3223; E04G 21/3204; E04F 11/1812; E04F 11/1814; E04F 11/1846; E04H 17/20; E04H 17/21; E04H 17/22; E04H 17/1473; E04H 17/1488
See application file for complete search history.

(56) References Cited

U.S. PATENT DOCUMENTS 5,605,204 A * 2/1997 Ausejo ..... E04G 7/307 182/186.7
6,330,998 B1 * 12/2001 Roy ..... E04H 17/12 256/19
6,691,826 B1 * 2/2004 Dean ..... E04G 21/3214 182/113
6,702,259 B2 * 3/2004 Pratt ..... E04F 11/1812 256/65.03
7,896,132 B2 3/2011 0'Gorman
8,113,473 B2 * 2/2012 Bradley ..... F16B 9/054 248/121
8,132,792 B2 3/2012 Perris
8,448,923 B1 5/2013 Schad et al.
8,979,418 B2 * 3/2015 Whiteley ..... E01F 13/022 404/6
9,109,370 B2 * 8/2015 Kreller ..... E04G 7/301
9,617,744 B2 * 4/2017 House ..... E04G 5/001
9,920,541 B2 * 3/2018 Erath ..... E04G 7/20
10,161,161 B2 * 12/2018 Yin ..... E04H 17/16
10,961,672 B2 * 3/2021 Wahlin ..... E04H 17/18
(Continued)

FOREIGN PATENT DOCUMENTS

DE 102009044483 A1 * 5/2011 ..... E04G 21/3223
DE 102017220696 * 5/2019
FR 2986812 A1 * 8/2013 ..... E04G 21/3228

OTHER PUBLICATIONS

Hae Kwang Co., Ltd. Raised Access Floor Systems. Website, www.haekwang.com, originally downloaded May 29, 2019, 12 pages.

(Continued)

*Primary Examiner* — Jonathan P Masinick
(74) *Attorney, Agent, or Firm* — Craig R. Miles; CR Miles P.C.

(57) ABSTRACT

Generally, a stanchion including a base configured to fasten to a support surface to dispose an elongate member in an upright condition. Specifically, a plurality of stanchions configured for interconnection by barrier elements to cordon off an area with a barrier wall.

19 Claims, 8 Drawing Sheets

(56) References Cited

U.S. PATENT DOCUMENTS

| | | | | |
|---|---|---|---|---|
| 2009/0095947 | A1* | 4/2009 | Supples | E04G 21/3223 256/64 |
| 2010/0078263 | A1* | 4/2010 | Kreller | E04G 1/14 182/113 |
| 2012/0228060 | A1* | 9/2012 | Rogers | E04G 7/301 182/178.5 |
| 2013/0330117 | A1* | 12/2013 | Kreller | E04G 7/32 403/49 |
| 2015/0308148 | A1* | 10/2015 | Herman | E04F 11/1814 256/47 |

OTHER PUBLICATIONS

Hae Kwang Co., Ltd. Raised Access Floor Systems. Aluminum Panel. Website, www.haekwang.com, originally downloaded Jun. 20, 2019, 2 pages.

* cited by examiner

STANCHION

I. FIELD OF THE INVENTION

Generally, a stanchion including a base configured to fasten to a support surface to dispose an elongate member in an upright condition. Specifically, a plurality of stanchions configured for interconnection by barrier elements to cordon off an area with a barrier wall.

II. SUMMARY OF THE INVENTION

A broad object of particular embodiments of the invention can be to provide a stanchion including one or more of an elongate member, a base coupled to the elongate member first end, the base first side configured to engage a support surface to support the elongate member in an upright condition, a first annular frame having a first frame inner edge joined proximate the elongate member second end, and a plurality of gussets, each having a gusset first face connected to the elongate member and a gusset edge connected to the base second side, the plurality of gussets outwardly extending from the elongate member in orthogonal angular relation.

Another broad object of particular embodiments of the invention can be to provide a stanchion including one or more of an elongate member, a base coupled to the elongate member first end, the base first side configured to engage a support surface to support the elongate member in an upright condition, a first annular frame having a first frame inner edge joined proximate the elongate member second end, the first annular frame including a securement assembly to removably stack or couple a first stanchion to a second stanchion, the securement assembly including at least one securement pin of a first stanchion and a securement aperture of a second stanchion configured to receive the securement pin of the first stanchion.

Another broad object of particular embodiments of the invention can be to provide a method of making a stanchion including one or more of coupling a base to an elongate member first end, the base first side configured to engage a support surface to support the elongate member in an upright condition, joining first annular frame inner edge of a first annular frame to the elongate member proximate the elongate member second end, and outwardly extending a plurality of gussets from the elongate member in orthogonal angular relation, the gusset first face connected to the elongate member and the gusset edge connected to the base second side.

Another broad object of particular embodiments of the invention can be to provide a method of making a stanchion including one or more of coupling a base to an elongate member first end, the base having a base first side configured to engage a support surface to support the elongate member in an upright condition, joining a first annular frame inner edge of a first annular frame to the elongate member proximate the elongate member second end, and disposing a securement assembly including at least a securement pin and a securement aperture on said first annular frame to allow a first stanchion to removably stack or couple to a second stanchion.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
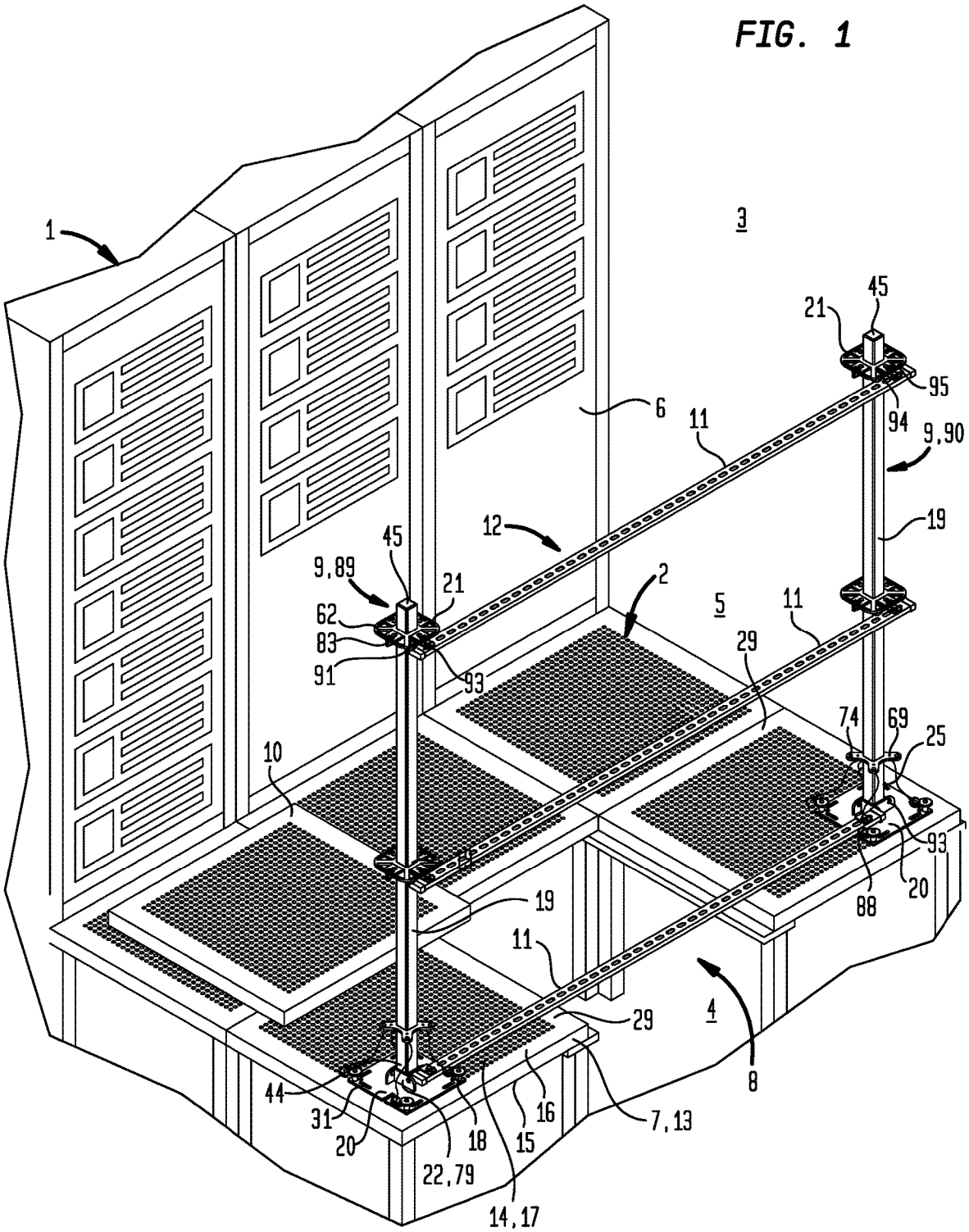
FIG. 1 is an illustration depicting a method of using a particular embodiment of a pair of the inventive stanchions fastened to a support surface in the form of a plurality of perforated floor tiles to support a barrier.

Referring primarily to FIG. 1, a computer server room (1) can include a raised floor (2) dividing the server room interior space (3) into a plenum space (4) underneath the raised floor (2) and server space (5) above the raised floor (2). The raised floor (2) permits the plenum space (4) to include a distribution system to allow conditioned air to flow underneath and through the raised floor (2) into the server space (5) to control the temperature of the computer servers (6), run conduits of power cabling, run conduits to carry chilled water, provide a copper ground grid for grounding of equipment, and place tracks, conduits, and supports for data communication cabling.

In a computer server room (1) having raised flooring, the plenum space (4) underneath the raised floor (2) can be accessed for maintenance. In accessing the plenum space (4), raised floor tiles (7) can be removed, resulting in an open area (8) in the raised floor (2) through which personnel and physical objects may fall through and become injured or damaged. To prevent injury to personnel and damage to objects, embodiments of the inventive stanchions (9) can be disposed in fixed spatial arrangement about the removed floor tiles (10) to cordon off the open area (8) inclusive of the removed floor tiles (10) and to provide notice to personnel of the open area (8) defined by the fixed spatial arrangement of the stanchions (9). In particular embodiments, a plurality of stanchions (9) can be interconnected by barrier elements (11) to provide a barrier wall (12).

Again, with reference primarily to FIG. 1, the raised floor (2) can, but need not necessarily, comprise removable perforated floor tiles (13). Perforated floor tiles (13) can include a plurality of apertures (14) which communicate between a floor tile first side (15) and a floor tile second side (16) to allow fluid communication between the plenum space (4) and the server space (5) of the computer server room (1). The plurality of apertures (14) can afford a support surface aperture pattern (17) over the perforated floor tile (13) which can be utilized to affix the stanchion (9) to the perforated floor tiles (13). The stanchion (9) can be affixed to the perforated floor tile (13) by passing one or more fastener elements (18) through a corresponding one or more of the plurality of apertures (14) and securing the fastener element (18) on the floor tile second side (16).

Figure 2:
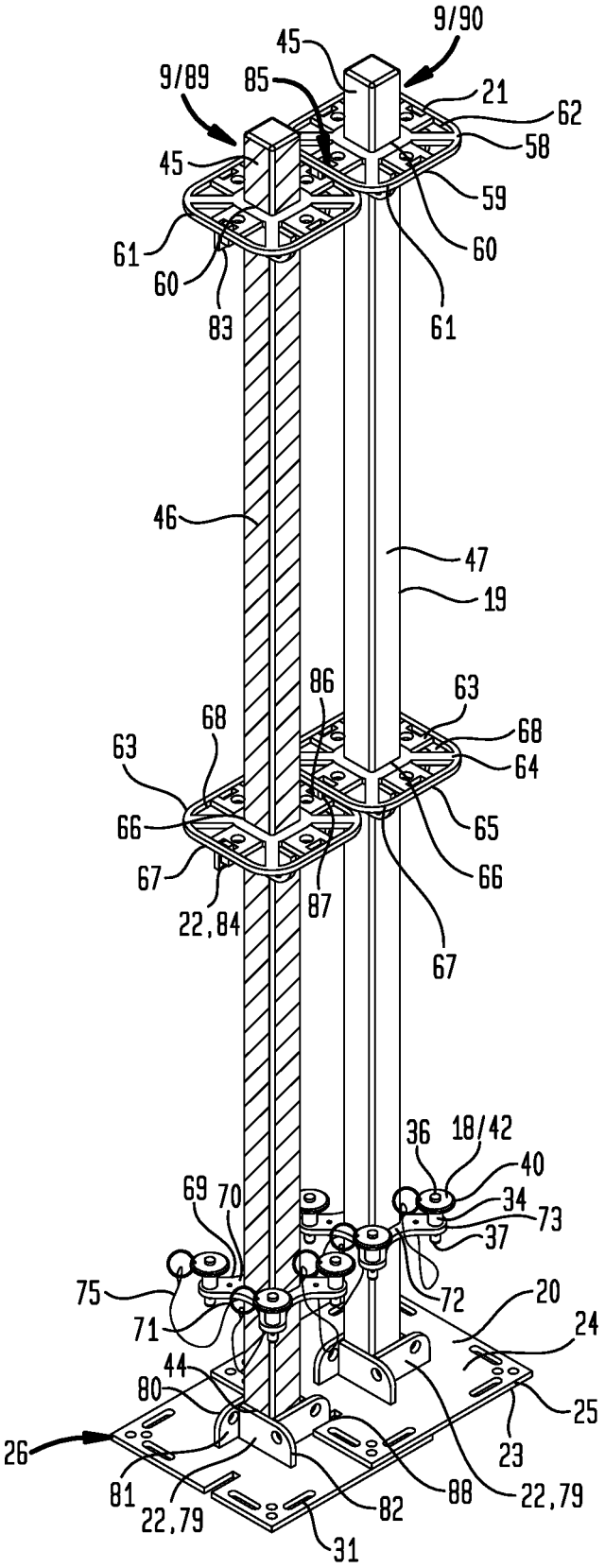
FIG. 2 is an illustration depicting a method of using a securement assembly of a particular embodiment of the inventive stanchion to releasably stack a first stanchion to a second stanchion.
Figure 3:
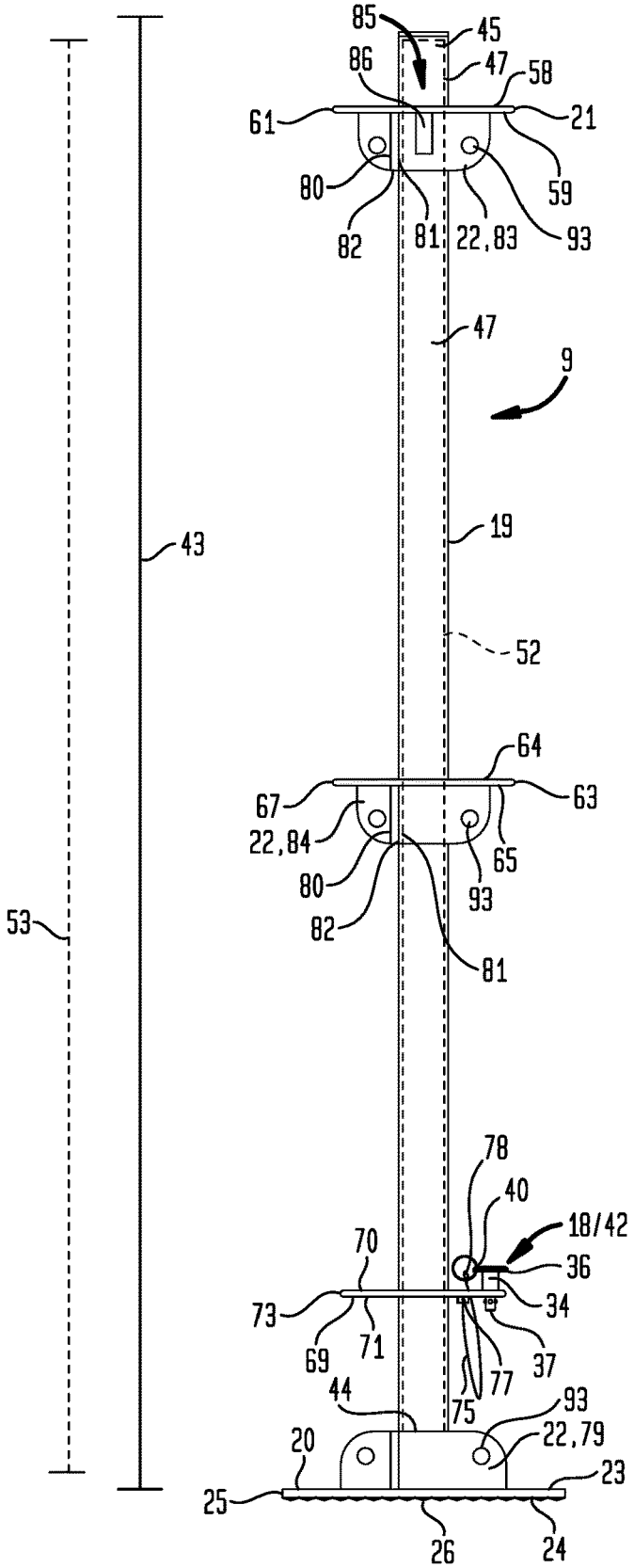
FIG. 3 is a first side elevation view of a particular embodiment of the inventive stanchion.
Figure 4:
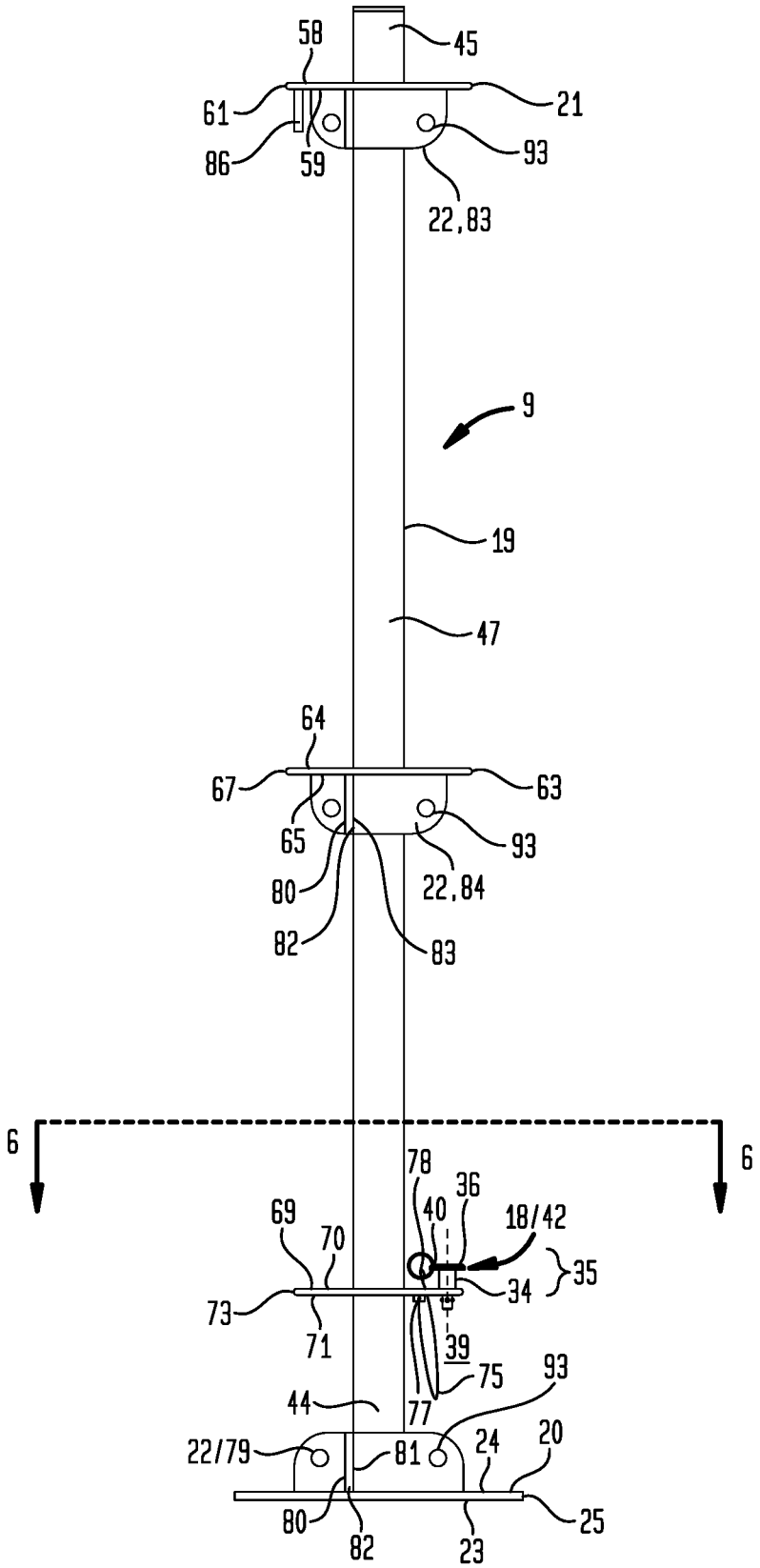
FIG. 4 is a second side elevation view of a particular embodiment of the inventive stanchion.

Now with reference primarily to FIG. 2, the removed floor tile(s) (10) can be placed back into position in the raised floor (2), and the stanchion(s) (9) can be unfastened from the raised floor (2). Storage of a plurality of stanchions (9) side by side would necessarily occupy floor area. However, stacking of a plurality of stanchions (9) can occupy less floor area, thus, there can be an advantage in being able to stack a plurality of stanchions (9)(89)(90) to afford additional available floor area.

Again, with general reference to FIGS. 1 through 11, embodiments of a stanchion (9) capable of being fastened to perforated floor tiles (13) can include one or more of an elongate member (19), a base (20), a first annular frame (21), and a plurality of gussets (22). The base (20) can have a base first side (23) opposite a base second side (24) extending to a base periphery (25). The base periphery (25), while shown in the Figures having a generally square geometry, can define any of a variety of geometric configurations including as illustrative examples a square, a hexagon, a pentagon, diamond, lozenge or other polygonal configurations, or a circle, an oval, or nongeometric shapes having irregular contours. The base first side (23) can be substantially flat. In particular embodiments, the base first side (23) can be substantially smooth, while in particular embodiments the base first side (23) can further include patterned surface elements (26) which can be useful in aligning the base first side (23) with an aperture pattern (17) which may be repeated over the perforated floor tile (13). The term "patterned surface element (26)" means a surface having a pattern with at least two areas which differ in physical structure, and without sacrificing the breadth of the foregoing definition, the differences may be due to the difference in depth of the surface structure, the difference in lateral density of the surface structure, the periodicity of the surface structure, the isotropy or anisotropy of the surface structure, the direction of the anisotropy axis of the surface structure, or combinations thereof, and specifically as illustrative examples includes: corrugates, knurling, small protuberances, excrescence, series of small ridges, beads, or concavities disposed on a surface. The base second side (24) can be substantially flat as shown in the Figures; however, in particular embodiments, the base second side (24) may not be substantially flat, but rather can be spherical, conical, pyramidal, or other configuration in support of the elongate member (19).

Again, with primary reference to FIG. 1, in particular embodiments, the base first side (23) can be configured to mateably engage a raised floor (2), floor tiles (7) or other a support surface. The illustrative example of FIG. 1 shows a raised floor (2) including a plurality of perforated floor tiles (13) available from Hae Kwang Company, Ltd, PN APH-240STR. In this illustrative example of a raised floor tiles (7), a plurality of apertures (14) are centrally disposed and extend to an unperforated peripheral margin (29). The plurality of aperture elements (14) are disposed in the floor tiles (7) at regularly spaced intervals in equidistant rows and columns. However, this illustrative example is not intended to preclude embodiments of the stanchion (9) which can be used with other floor tiles, floor panels, or floor grates which may, but need not necessarily, be raised to afford a plenum space (4) and a server space (5) within a server room interior space (3).

Now, with primary reference to FIGS. 1 through 9, the base (20) can include a plurality of base aperture elements (31). Each of the plurality of base aperture elements (31) can communicate between the base first side (23) and the base second side (24) of the base (20). The plurality of base aperture elements (31) can be disposed about the base (20) in a base aperture element pattern (32). The base aperture element pattern (32) can permit each, or a portion, of the plurality of base aperture elements (31) to correspondingly align with the aperture pattern (17) of the plurality of apertures (14) in the floor tiles (7). In particular embodiments, each of the plurality of base aperture elements (31) can, but need not necessarily, can have a configuration to match the configuration of the plurality of apertures (14) in the floor tile (7). By way of illustrative example, each of the plurality of base aperture elements (31) can have a circular configuration, each alignable with a corresponding plurality of apertures (14) having substantially the same circular configuration. By way of a second illustrative example, the base aperture elements (31) can have an elongate slot configuration, each alignable with a corresponding plurality of aperture elements (14) having a circular configuration. However, these illustrative examples are not intended to preclude embodiments of the plurality of base aperture elements (31) having other base aperture element patterns (32) or base aperture element (31) configurations allowing one or a plurality of base aperture elements (31) to be aligned with corresponding plurality of apertures (14) or aperture pattern (17).

Now, with primary reference to FIGS. 1 through 4 and 8, particular embodiments of the stanchion (9) can further include at least one fastener element (18). The fastener element (18) can include a fastener element body (34) having a length (35) disposed between a fastener element first end (36) and a fastener element second end (37). The fastener element length (35) can be sufficient to pass through a base aperture element (31) and an aligned aperture element (14) to affix the base (20) to a perforated floor tile (13) or other perforated support surface (28). Typically, the stanchion (9) can include a plurality of fastener elements (18) externally configured to correspond to the configuration of all or a portion of the base aperture elements (31). The cross-sectional area perpendicular to the fastener longitudinal axis (39) can be circular (as shown the illustrative example of FIG. 4) is not meant to preclude embodiments of the fastener element body (34) having a different cross-sectional area such as an oval, an ellipse, a polygonal configuration other configuration. Typically, the fastener element first end (36) can include a flange (40) disposed proximate the fastener element first end (36) which extends a distance outward from the fastener element body (34). In particular embodiments, the fastener element (18) can, but need not necessarily, be a ball lock bolt (42), or a rapid release pin. A fastener element (18) suitable for use with embodiments of the invention can be obtained from Monroe Hardware, PN LBH-104, or similar rapid release pin. However, this illustrative example is not intended to preclude other embodiments in which the fastener element second end (37) mateably couples to an end piece, such as, a mateable threaded surfaces.

Now, with primary reference to FIGS. 1 through 11, the elongate member (19) can have a length (43) disposed between a member first end (44) coupled to the base (20) and a terminal member second end (45). Typically, the elongate member (19) will be disposed in generally orthogonal relation to the base (20); although in particular embodiments, the elongate member (19) can be disposed in angled relationship to the base (20). The elongate member (19) can be solid, tubular, or a combination thereof. The elongate member (19) can have a variety of orthogonal cross-sectional configurations including as illustrative examples: polygonal cross sectional configurations such as a triangle, a rectangle, a square, or non-polygonal cross-sectional configurations such as a circle, an oval, or otherwise. The elongate member (19) can comprise a metal such as stainless steel, iron, magnesium, or aluminum, or a non-metal such as a plastic whether rigid or flexible, such as polyethylene, polypropylene; or ceramic, or combinations thereof. In particular embodiments, the elongate member (19) can comprise a material selected to afford one or more colors, or a color layer (46) can be disposed on the elongate member external surface (47) (as shown in the illustrative example of FIG. 2 by diagonal lines). The color of the elongate member (19) or color layer (46) can be selected from the group consisting of: red, orange, yellow, green, blue, violet, black, brown, silver, or white, and any combination thereof. In the context of a server space (5) in which the environment can be monochromatic, or have one predominate color, the color of the elongate member (19) or color layer (46) can be critical to provide notice of the barrier wall (12).

Now with primary reference to FIGS. 3, 8, 10 and 11, in particular embodiments, the elongate member (19) can comprise an outer elongate tubular member (48). The outer elongate tubular member (48) can have elongate member thickness disposed between a tubular member external surface (49) and a tubular member internal surface (50). Both of the tubular member external and internal surfaces (49) (50) can extend the length (43) of the outer elongate tubular member (48). The tubular member internal surface (50) can define a tubular member interior space (51). In particular instances, the elongate member thickness can be adjusted to afford a requisite level of rigidity.

Again, with primary reference to FIGS. 3, 8, 10, and 11, in particular embodiments, an inner tubular member (52) can be disposed within the tubular member interior space (51) of the outer elongate tubular member (48). The inner tubular member (52) can have a length (53) disposed between an inner tubular member first end (54) and an inner tubular member second end (55). The length (53) can be less than or substantially equal to the length (43) of the outer elongate tubular member (48). The inner tubular member (52) can further be a solid member or a tubular member, or a combination thereof. In particular embodiments, the inner tubular member (52) can have a cross-sectional configuration generally similar to, the same as or different from the cross-sectional configuration of the outer elongate tubular member. The cross-sectional configuration of the inner tubular member (52) can, but need not necessarily, be congruent to the cross-sectional configuration of the outer elongate tubular member (48). In particular embodiments, the inner tubular member (52) can be disposed in the outer elongate tubular member (48) to directly abut the tubular member internal surface (50) to the inner tubular member external surface (56). In particular embodiments, the inner tubular member (52) can be disposed in the outer elongate tubular member (48) to provide for an annular space (57) between the tubular member internal surface (50) and the inner tubular member external surface (56). In particular embodiments, the outer elongate tubular member (48) can, but need not necessarily, flex until the outer tubular member internal surface (50) contacts the inner tubular member external surface (56) to lend limited flexure to the outer elongate tubular member (48). The outer elongate tubular member (48) and the inner tubular member (52) can comprise similar or dissimilar materials affording the requisite limited resilient flexure or flexure of the outer elongate tubular member (48) and the requisite rigidity in abutted relation to the inner tubular member (52).

Now, with primary reference to FIGS. 1 through 7, particular embodiments of the stanchion (9) can include a first annular frame (21). The first annular frame (21) can have a first annular frame first side (58) opposite a first annular frame second side (59). The first annular frame (21) can extend between a first frame inner edge (60) and a first frame outer edge (61). The first frame outer edge (61) can define any of various geometric and non-geometric configurations including as illustrative examples: a circle, an ellipse, a square, a rectangle, or other polygonal configurations; although these illustrative examples are not intended to preclude embodiments having other configurations. The first frame inner edge (60) can be coupled in fixed spatial relation to the elongate member (19) proximate the elongate member second end (45).

Again, with primary reference to FIGS. 1 through 7, particular embodiments of the first annular frame (21) can include a plurality of first frame aperture elements (62). The first frame aperture elements (62) can be disposed in the first annular frame (21) between the first frame inner edge (60) and the first frame outer edge (61). Each of the plurality of first frame aperture elements (62) can communicate between the first annular frame first side (58) and the first annular frame second side (59). The first frame aperture elements (62) can, but need not necessarily, be disposed in the first annular frame (21) in a regular pattern.

Now with primary reference to FIGS. 1 through 4, particular embodiments of the stanchion (9) can include a second annular frame (63). The second annular frame (63) can have a second frame first side (64) opposite a second frame second side (65). The second frame first side (64) and the second frame second side (65) can extend between a second frame inner edge (66) and a second frame outer edge (67). The second frame outer edge (67) can define various geometric configurations including a circle, ellipse, square, rectangle, hexagon, or other like geometric configuration. The second frame inner edge (66) can be medially joined to the elongate member (19) between the elongate member first end (44) and the elongate member second end (45).

Again, with primary reference to FIGS. 1 through 4, particular embodiments of the second annular frame (63) can include a plurality of second frame aperture elements (68). Each of the second frame aperture elements (68) can be disposed in the second annular frame (63) between the second frame first side (64) and the second frame second side (65). Each of the second frame aperture elements (68) can communicate between the second frame first side (64) and the second frame second side (65). The second frame aperture elements (68) can, but need not necessarily, be disposed in the first annular frame (21) in a regular pattern.

Now with primary reference to FIGS. 1 through 4 and 8, in particular embodiments, the stanchion (9) can include a fastener holder (69). The fastener holder (69) can have a fastener holder first side (70) opposite a fastener holder second side (71). The fastener holder first side (70) and fastener holder second side (71) can extend between a fastener holder inner edge (72) to a fastener holder outer edge (73). The fastener holder inner edge (72) can be joined to the elongate member (19) proximate the elongate member first end (44). In particular embodiments, at least one fastener holder aperture (74) can be disposed in the fastener holder (69). The fastener holder aperture (74) can communicate between the fastener holder first side (70) and the fastener holder second side (71). The at least one fastener holder aperture (74) can be configured to correspondingly receive at least one fastener element (18). In further particular embodiments, a plurality of fastener holder apertures (74) can be disposed in the fastener holder (69). The plurality of fastener holder apertures (74) can, but need not necessarily, correspond to a plurality of fastener elements (18).

Again, with primary reference to FIGS. 1, 2, 3 and 6, particular embodiments of the stanchion (9) can include a tether element (75). The tether element (75) can have a length disposed between a tether first end (77) and a tether second end (78). The tether first end (77) can be coupled to the fastener holder (69). The tether second end (78) can be coupled to a fastener element (18). In particular embodiments having a plurality of fastener elements (18), a plurality of tether elements (75) can correspondingly be coupled to each of the plurality of fastener elements (18) and the fastener holder (69).

Now, with primary reference to FIGS. 1 through 11, particular embodiments of the stanchion (9) can include a first plurality of gussets (79). The first plurality of gussets (79) can outwardly extend from the elongate member (19) in orthogonal angular relation. Each of the first plurality of gussets (79) can have a gusset first face (80) opposite a gusset second face (81). The gusset first face (80) and the gusset second face (81) can extend to a gusset edge (82). The gusset first face (80) can be connected to the elongate member (19). The gusset edge (82) can be connected to the base second side (24).

Again, with primary reference to FIGS. 1 through 11, particular embodiments of the stanchion (9) can include a second plurality of gussets (83). The second plurality of gussets (83) can outwardly extend from the elongate member (19) in orthogonal angular relation. Each of the second plurality of gussets (83) can have a gusset first face (80) opposite a gusset second face (81). The gusset first face (80) and the gusset second face (81) can extend to a gusset edge (82). The gusset first face (80) can be connected to the elongate member (19). The gusset edge (82) can be connected to the first frame inner edge (60).

Again, with reference to FIGS. 1 through 8, particular embodiments of the stanchion (9) can include a third plurality of gussets (84). The third plurality of gussets (84) can outwardly extend from the elongate member (19) in orthogonal angular direction. Each of the third plurality of gussets (84) can have a gusset first face (80) opposite a gusset second face. The gusset first face (80) and the gusset second face (81) can extend to a gusset edge (82). The gusset first face (80) can be connected to the elongate member (19). The gusset edge (82) can be connected to the second frame inner edge (66).

Now with primary reference to FIGS. 2, 3, 4 and 6, particular embodiments of the stanchion (9) can include a securement assembly (85) including one or more of at least one securement pin (86), a securement aperture (87), and base gusset slot (88). The securement pin (86) can be coupled to the first annular frame (21) or the second annular frame (63). The securement pin (86) can further extend in generally orthogonal relation to the respective first annular frame (21) or the second annular frame (63) toward the base (20). In particular embodiments, the securement assembly (85) can further include at least one securement aperture (87) configured to receive the at least securement pin (86) when first and second stanchions (89)(90) are removably stacked or coupled as shown in the example of FIG. 2. The securement aperture (87) can be disposed in the first annular frame (21) or the second annular frame (63) to correspondingly receive a securement pin (86) coupled to the first or second annular frame (21)(63). Now with primary reference to FIG. 2, upon disposing the securement pin (86) of a first stanchion (89) in the securement aperture (87) of a second stanchion (90), the bases (20) of the first stanchion (89) my overlappingly engage or overlap the second stanchion (90). In those embodiments which include a first plurality of gussets (79) which outwardly extend from the elongate member (19) in orthogonal angular relation having the gusset edge (82) connected to the base second side (24), the base (20) of the first stanchion may contact the gusset edge (82) prohibiting the elongate member (19) of the first stanchion (89) being disposed in parallel relationship. In particular embodiments, the stanchion base (20) can include a base gusset slot (88) disposed to receive the gusset (22) in the base gusset slot (88) allowing the elongate members (19) of the first stanchion (89) when stacked with the second stanchion (90) to be disposed in parallel relation.

Figure 5:
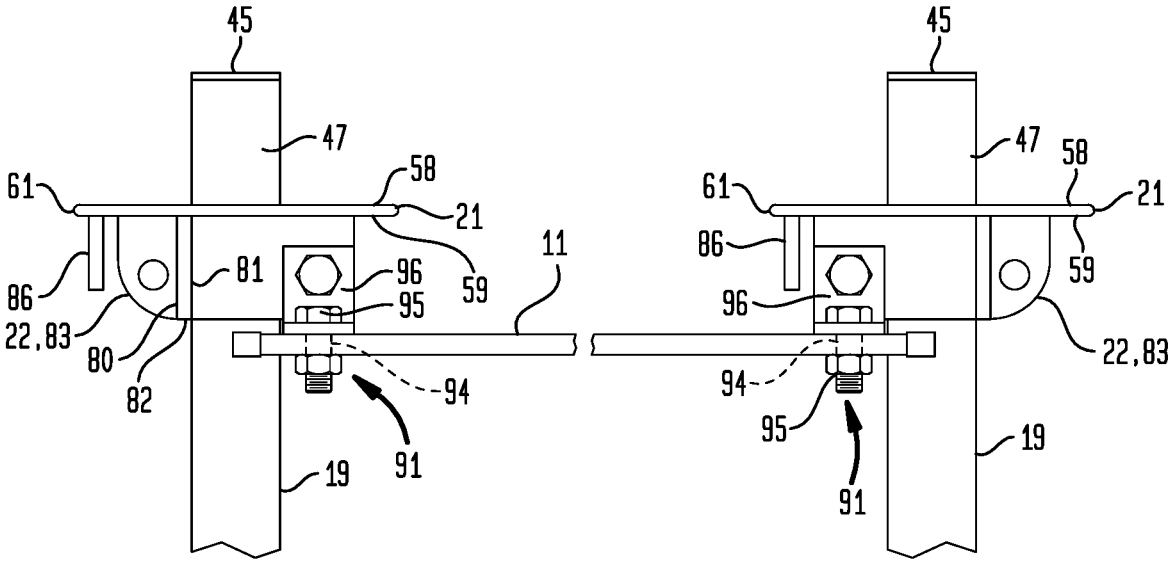
FIG. 5 is a second end plan view of a particular embodiment of the inventive stanchion.
Figure 6:
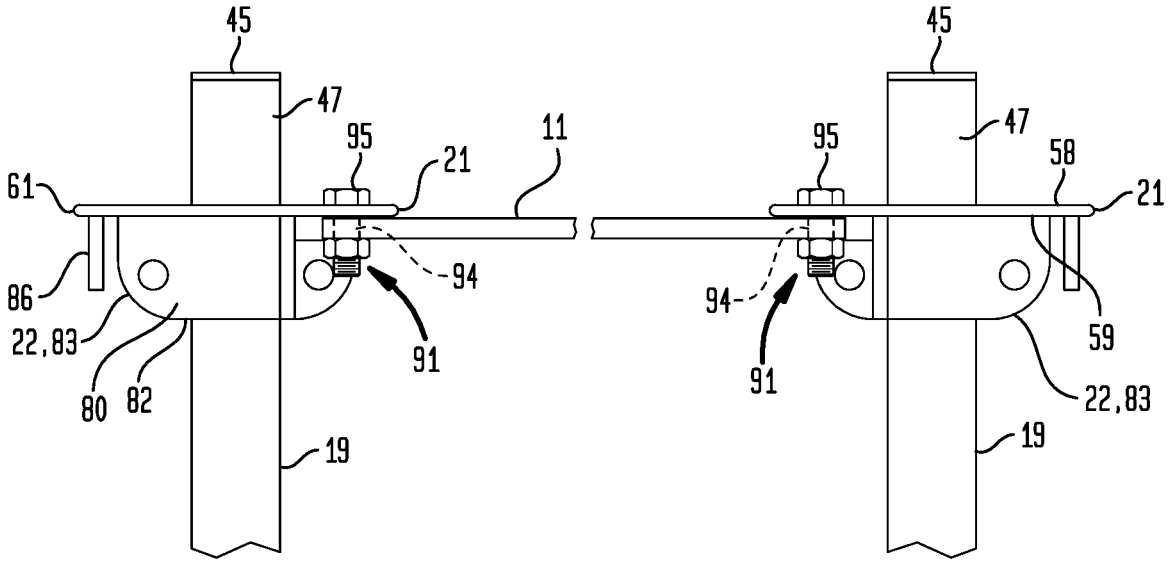
FIG. 6 is a cross-section view 6-6 of the particular embodiment of the inventive stanchion shown in FIG. 4.
Figure 7:
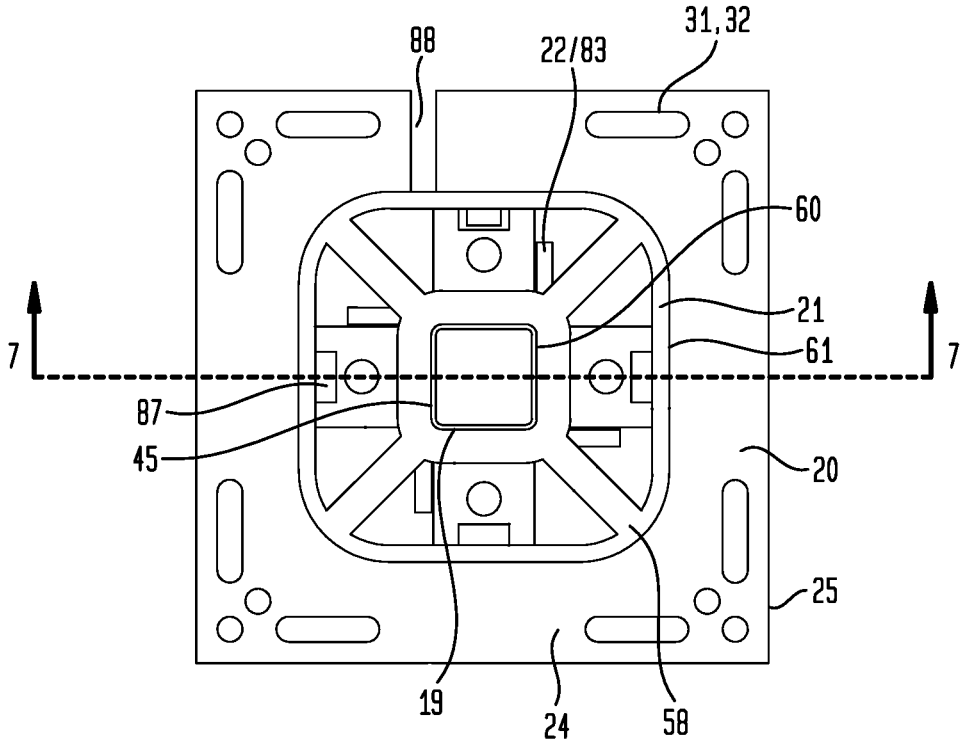
FIG. 7 is a cross-section view 7-7 of the particular embodiment of the inventive stanchion shown in FIG. 5.
Figure 8:
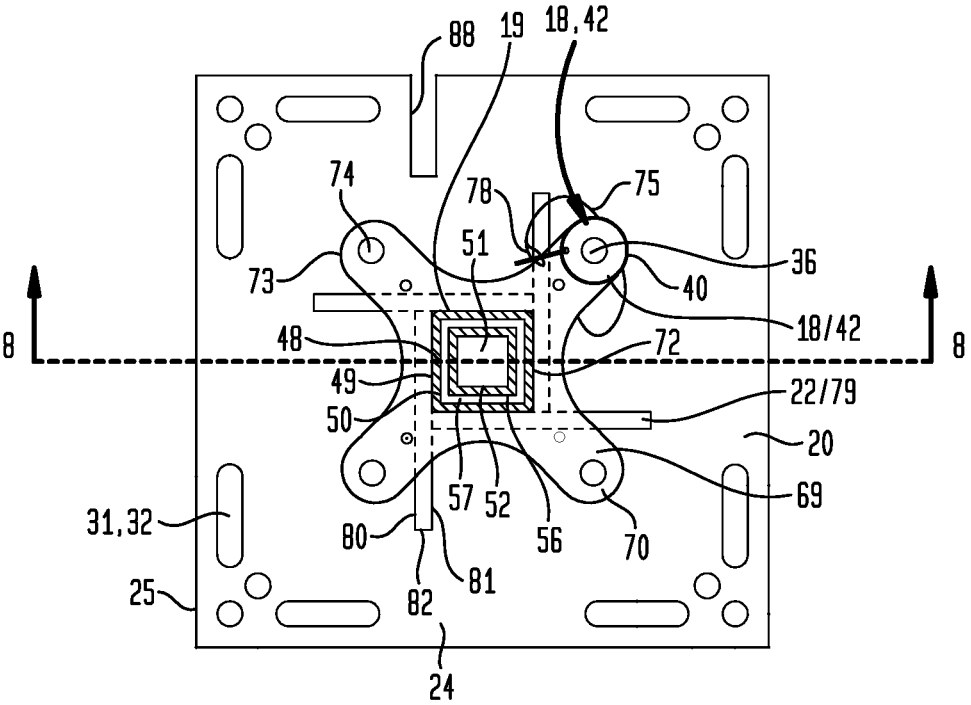
FIG. 8 is a cross-section view 8-8 of the particular embodiment of the inventive stanchion shown in FIG. 6.
Figure 9:
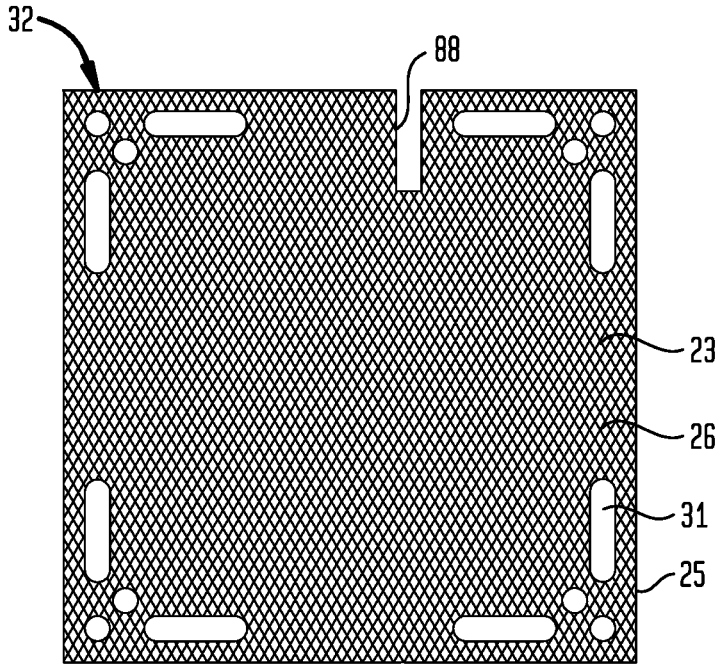
FIG. 9 is a depiction of a base first side having patterned surface elements.
Figure 10:
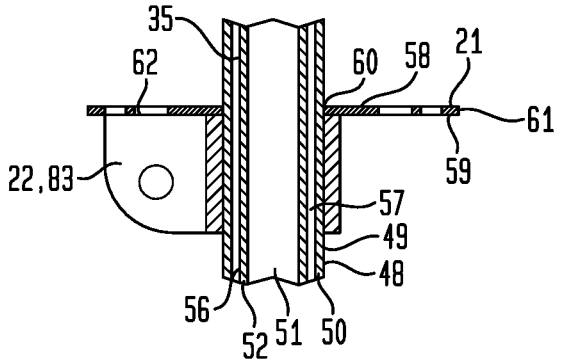
FIG. 10 is a cross-section 10-10 of the particular embodiment of the inventive stanchion shown in FIG. 4.
Figure 11:
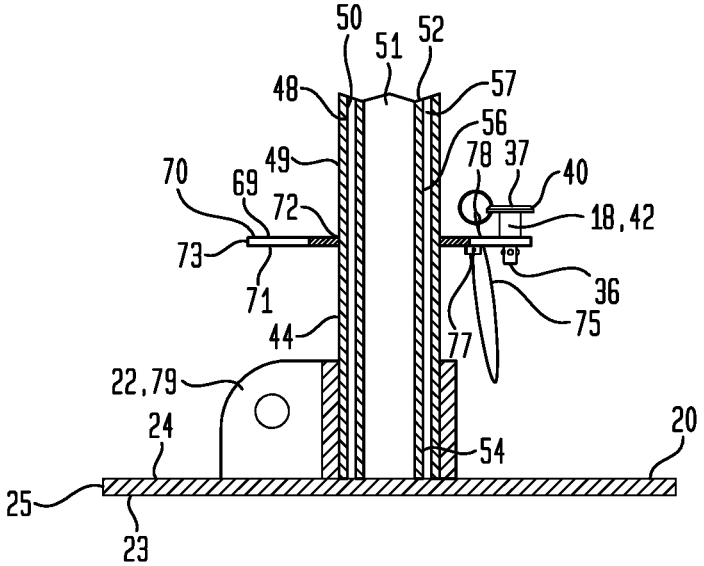
FIG. 11 is cross-section 11-11 of the particular embodiment of the inventive stanchion shown in FIG. 4.

Now, with primary reference to FIGS. 1 and 5 and 6, particular embodiments of the stanchion (9) can include one or more barrier connectors (91). The barrier connector (91) can be disposed in at least one of the first plurality of gussets (79), the second plurality of gussets (83), or the third plurality of gussets (84), or a combination thereof. The barrier connector (91) can be adapted to removably secure a barrier element (22) to one or more stanchions (9). In particular embodiments, the barrier connector (91) can include a barrier connector aperture (93) which communicates between the gusset first face (80) and the gusset second face (81). The barrier connector aperture (93) can be alignable with the barrier aperture (94). A barrier fastener (95) can pass through the barrier connector aperture (93) and the barrier aperture (94) to directly or indirectly through bracket (96) removably secure a barrier (11) to one stanchion (9) or between a first and second stanchion (89)(90) or a plurality of stanchions (9).

In particular embodiments, the barrier (11) can be removably secured to the first frame aperture elements (62) or the second frame aperture elements (68). As a nonlimiting example, a barrier (11) can include a barrier aperture (94). The barrier aperture (94) can be aligned with a first frame aperture element (62). A barrier fastener (95) can pass through the barrier aperture (94) and the first frame aperture element (62) to removably secure the barrier (11) to the first frame aperture element (62). In a similar manner, a barrier (11) can be removably secured to a second frame aperture element (68). However, the foregoing example is not meant to be limiting.

In further particular embodiments, a plurality of barriers (11) can be removably secured to one stanchion (9) or between a plurality of stanchions (9). Each of the plurality of barriers (11) can be removably secured to a barrier connecter (91) disposed in at least one of the first plurality of gussets (79), the second plurality of gussets (83), or the third plurality of gussets (84), a first frame aperture element (62), a second frame aperture element (68), or a combination thereof. By way of example, FIGS. 1 and 5 show a plurality of barriers (11), each of the plurality of barriers (11) being coupled to a barrier connector (91) disposed in one of the first plurality of gussets (79), one of the second plurality of gussets (83), and the third plurality of gussets (84). However, the embodiment of FIGS. 1 and 5 are not meant to preclude other configurations of barrier connectors (91) to couple a barrier element (11) to a stanchion (9). In particular embodiments, only one barrier element (11) may be removably secured to a stanchion (9), only two barrier elements (11), or only three barrier elements (11). In particular embodiments, the barrier (11) can a rigid member as shown in the Figures such as a unistrut, or in the alternative can be a flexible chain, cable, caution tape, rope, or other flexible or in flexible member.

As can be easily understood from the foregoing, the basic concepts of the present invention may be embodied in a variety of ways. The invention involves numerous and varied embodiments of a stanchion and methods for making and using such stanchion including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "frame" should be understood to encompass disclosure of the act of "framing"—whether explicitly discussed or not—and, conversely, were there effectively disclosure of the act of "framing", such a disclosure should be understood to encompass disclosure of a "frame" or even a "means for framing." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the stanchions herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A stanchion, comprising:

an elongate member having a length disposed between a member first end and a member second end;

a base coupled to said member first end, said base having a base first side opposite a base second side extending to a base periphery, said base first side configured to engage a support surface to support said elongate member in an upright condition;

a first annular frame having a first frame first side opposite a first frame second side extending between a first frame inner edge and a first frame outer edge, said first frame inner edge joined to said elongate member proximate said elongate member second end;

a first plurality of gussets each having a gusset first face opposite a gusset second face extending to a gusset edge, said gusset first face connected to said elongate member and said gusset edge connected to said base second side, said plurality of gussets outwardly extending from said elongate member in orthogonal angular relation; and a second plurality of gussets each having a gusset first face opposite a gusset second face extending to a gusset edge, said gusset first face connected to said elongate member and said gusset edge connected to said first frame inner edge, said second plurality of gussets outwardly extending from said elongate member in orthogonal angular relation.

2. The stanchion of claim 1, further comprising a second annular frame having a second frame first side opposite a second frame second side extending between a second frame inner edge and a second frame outer edge, said second frame inner edge medially joined to said elongate member between said member first end and said member second end.

3. The stanchion of claim 2, further comprising a third plurality of gussets each having a gusset first face opposite a gusset second face extending to a gusset edge, said gusset first face connected to said elongate member and said gusset edge connected to said second frame inner edge, said third plurality of gussets outwardly extending from said elongate member in orthogonal angular relation.

4. The stanchion of claim 3, further comprising a plurality of base aperture elements communicating between said base first side and said base second side of said base, said plurality of base aperture elements disposed in said base to correspondingly align with a plurality of support surface aperture elements disposed in said support surface.

5. The stanchion of claim 4, wherein said support surface comprises a Hae Kwang panel, Model No. APH-240STR.

6. The stanchion of claim 4, further comprising at least one fastener element configured to pass through one of said plurality of base aperture elements and one of said plurality of support surface aperture elements to affix said base to said support surface.

7. The stanchion of claim 6, said at least one fastener element further comprises a plurality of fastener elements.

8. The stanchion of claim 7, wherein said fastener element comprises a ball lock bolt.

9. The stanchion of claim 6, further comprising a plurality of first frame aperture elements disposed in said first annular frame between said first frame inner edge and said first frame outer edge, said first frame aperture elements communicating between said first frame first side and said first frame second side.

10. The stanchion of claim 9, further comprising a plurality of second frame aperture elements disposed in said second annular frame between said second frame inner edge and said second frame inner edge, said second frame aperture elements communicating between said second frame first side and said second frame second side.

11. The stanchion of claim 10, further comprising:

a fastener element holder having a fastener element holder first side opposite a fastener element holder second side extending between a fastener element holder inner edge to a fastener element holder outer edge, said fastener element holder inner edge joined to said elongate member proximate said elongate member first end; and at least one fastener element holder aperture disposed on said fastener element holder, said fastener element holder aperture communicating between said fastener holder frame first side and said fastener element holder second side, said fastener element holder aperture configured to receive said fastener element.

12. The stanchion of claim 11, further comprising a tether element having a length disposed between a tether element first end and a tether element second end, said tether element first end coupled to said fastener element holder, said tether element second end coupled to said fastener element.

13. The stanchion of claim 12, wherein said tether element comprises a plurality of tether elements, said fastener element holder aperture comprises a plurality of fastener element frame apertures, said fastener element comprises a plurality of fastener elements, wherein each of said plurality of tether elements and each of said fastener element holder apertures corresponding to each of a plurality of fastener elements.

14. The stanchion of claim 1, further comprising a securement assembly to couple a first stanchion to a second stanchion, said securement assembly including:

at least one securement pin extending in generally orthogonal relation to said first annular frame or said second annular frame; and a securement aperture disposed in said first annular frame or said second annular frame;

wherein said securement pin and said securement aperture disposed on said first or second annular frame of said first and second stanchions to allow said securement aperture of said first stanchion to insertingly receive said securement pin of said second stanchion to removably couple said first stanchion to said second stanchion.

15. The stanchion of claim 1, wherein said elongate member comprises an elongate tubular member.

16. The stanchion of claim 15, further comprising an inner tubular member disposed inside of said elongate tubular member, said inner tubular member having an inner tubular member first end coupled to said base second side and an inner tubular member second end coupled proximate said member second end.

17. The stanchion of claim 1, wherein said elongate member has a color selected from the group consisting of: red, orange, yellow, green, blue, violet, black, or brown, and any combination thereof.

18. The stanchion of claim 1, further comprising a gusset barrier connector disposed on at least one of said plurality of gussets, said gusset barrier connector adapted to removably secure a barrier to said stanchion.

19. The stanchion of claim 18, wherein said gusset barrier connector comprises a gusset barrier connector aperture alignable with a barrier connector aperture through which a barrier fastener passes to removably secure a barrier to said stanchion.

* * * * *